US006879230B2

(12) United States Patent
Haudry et al.

(10) Patent No.: US 6,879,230 B2
(45) Date of Patent: Apr. 12, 2005

(54) MULTI-POLE CONTACTOR-CIRCUIT BREAKER TYPE SWITCH

(75) Inventors: Jean Haudry, Vernouilet (FR); Philippe Guibert, Chatou (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/197,576

(22) Filed: Jul. 18, 2002

(65) Prior Publication Data

US 2003/0016103 A1 Jan. 23, 2003

(30) Foreign Application Priority Data

Jul. 18, 2001 (FR) ..... 01 09638

(51) Int. Cl.[7] ..... H01H 67/02
(52) U.S. Cl. ..... 335/132; 335/202; 335/8
(58) Field of Search ..... 335/8–10, 132, 335/18, 202, 159–162; 200/293–308; 361/42–51

(56) References Cited

U.S. PATENT DOCUMENTS 5,652,420 A * 7/1997 Innes et al. ..... 200/50.32
5,894,395 A * 4/1999 Baurand et al. ..... 361/87
6,285,292 B1 * 9/2001 Suptitz et al. ..... 340/657

FOREIGN PATENT DOCUMENTS

FR 2 799 572 A 4/2001

* cited by examiner

*Primary Examiner*—Lincoln Donovan
(74) *Attorney, Agent, or Firm*—Parkhurst & Wendel, L.L.P.

(57) ABSTRACT

This invention relates to a multi-pole contactor—circuit breaker type switch composed of a housing (1) containing breaking poles (11) activated by a control electromagnet (16) and by a trip control mechanism (18, 14) and comprising a protection module (2) equipped with means (21) for measuring pole currents and means (22) for acting on the electromagnet (16) and on the trip control mechanism (14) if a fault current is detected, characterised by the fact that it comprises a control and/or communication module (3) that is installed removably on the housing, below the protection module (2) and communicating with the processing circuit (22) on the said protection module (2) through connectors (23, 33).

15 Claims, 4 Drawing Sheets

MULTI-POLE CONTACTOR-CIRCUIT BREAKER TYPE SWITCH

This invention relates to a multi-pole contactor circuit—breaker type switch composed of a housing containing breaking poles activated by a control electromagnet and by a trip control mechanism and comprising a protection module equipped with means for measuring pole currents and means for acting on the electromagnet and on the trip control mechanism if a fault current is detected.

A contactor—circuit breaker tests the current passing in current lines ("contactor" function) and provides protection ("circuit breaker" function) when an electrical fault appears on at least one of the lines (for example in the case of a short circuit), by means of breaking poles activated by an electromagnet. When an electrical fault occurs, a protection device with an electromagnetic trip acts on the poles. This device may be reset by a manual control device which also opens and closes the contacts.

The purpose of the invention is to supply a switch in which the electronic protection device cooperates with a removable module providing interface and connection functions with other equipment.

According to the invention, the switch comprises a control and/or communication module that is installed removably on the housing below the protection module and communicating with the processing circuit on the said protection module through connectors.

According to one specific feature, the control and/or communication module comprises state switches at the back mechanically actuated by the said control mechanism and/or the pole control electromagnet, in order to provide state information about the poles and/or the trip mechanism.

The invention will now be described in more detail with reference to embodiments given as examples and represented by the appended drawings in which.

Figure 1:
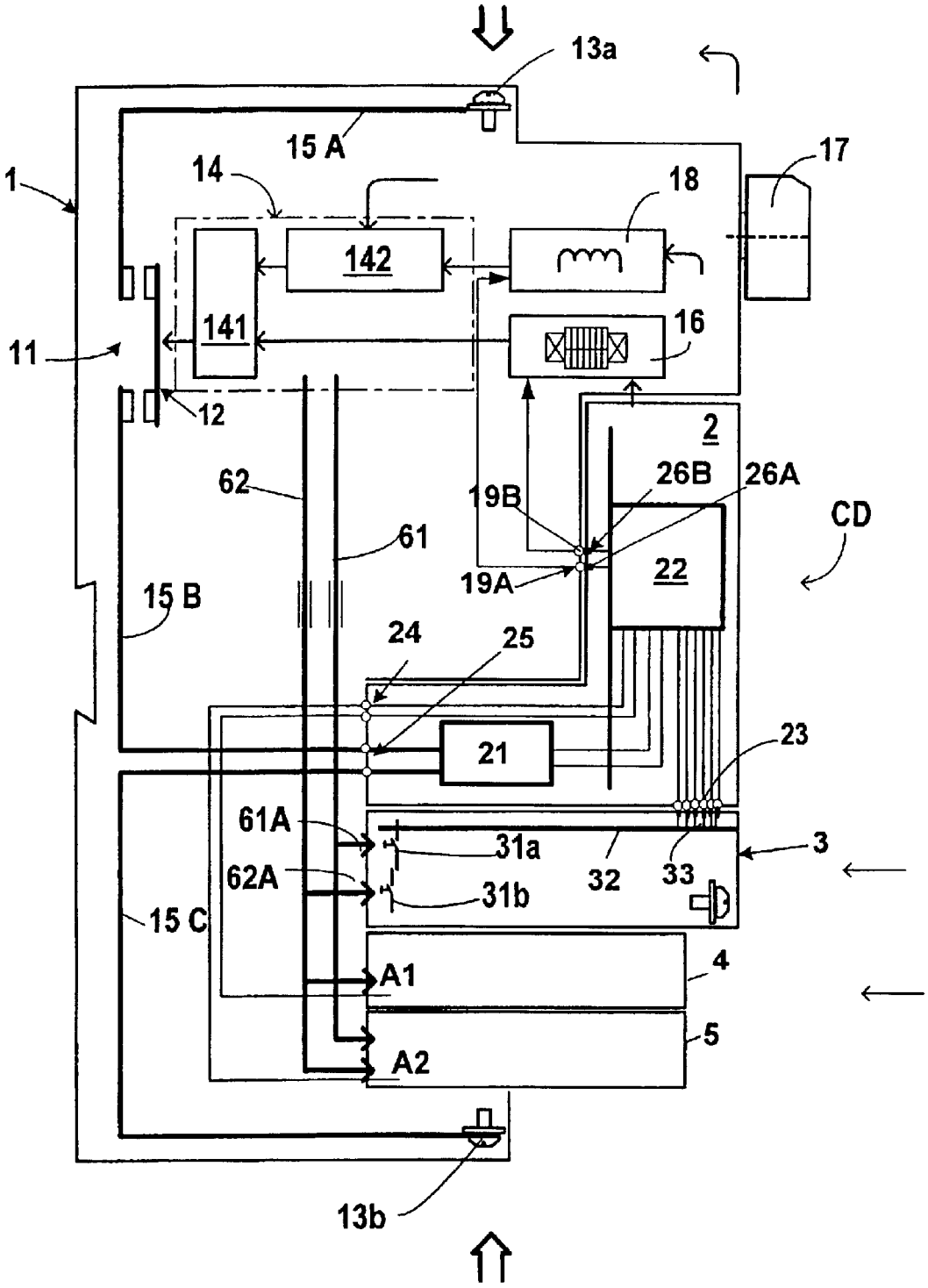
FIG. 1 is a diagram showing a side view of a contactor circuit breaker conform with the invention.
Figure 2:
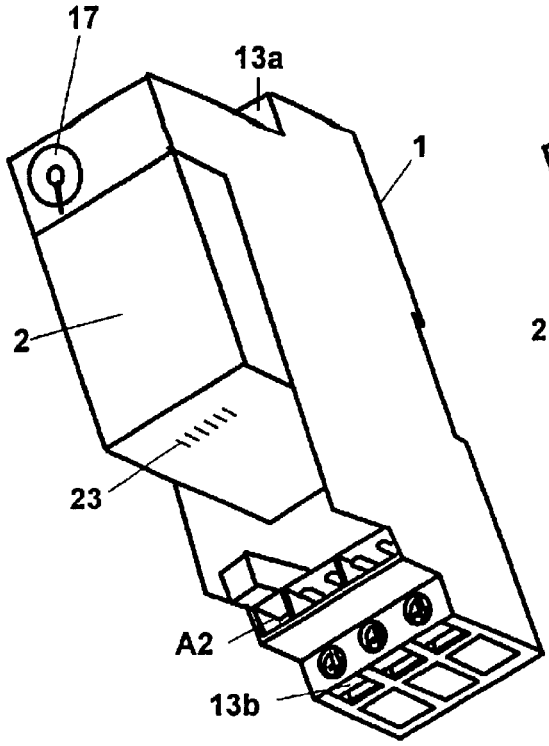
FIG. 2 is a perspective view of the contactor—circuit breaker on which the control or communication module has been removed.
Figure 3:
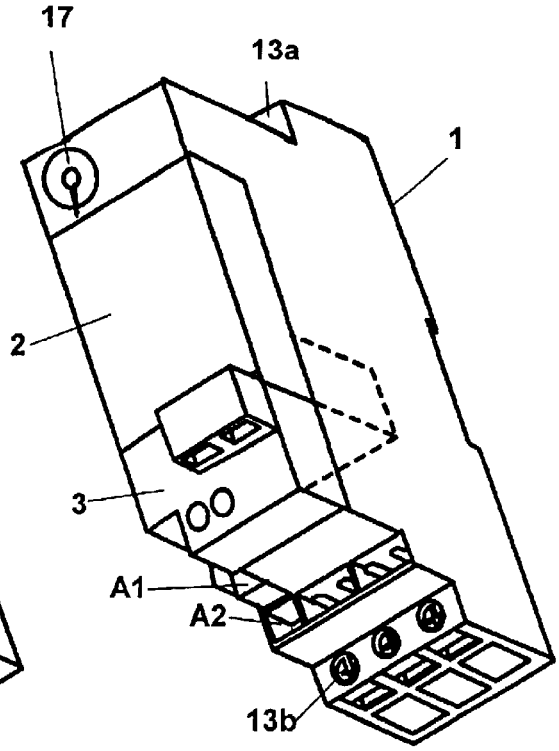
FIG. 3 is a perspective view of the contactor—circuit breaker on which the control or communication module is installed.
Figure 4:
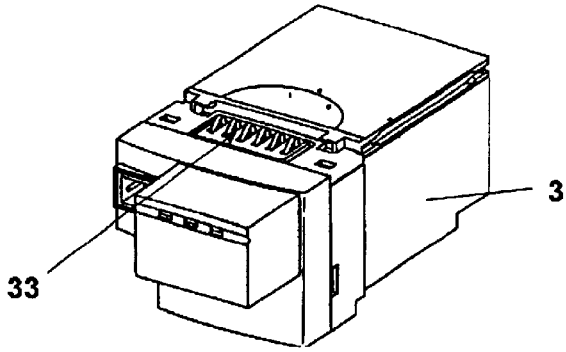
FIG. 4 is a perspective view of a control and communication module.

The contactor—circuit breaker reference CD as illustrated in FIG. 1 comprises a housing 1 containing chambers and breaking poles, and a control part in contactor mode.

The housing 1 comprises a pole 11 with separable contacts 12 and preferably with double break (single break as a variant), on each power current line 15. A single pole is shown in FIG. 1, but the switch is multi-pole.

Each power current line 15 will be connected to a power supply on the input side and to a load on the output side. Power terminal blocks 13*a*, 13*b* are located near the top and bottom of housing 1 for connections to the power lines (according to the arrows shown).

The mobile contacts 12 of the poles 11 are actuated by the control part in contactor mode, under the control of the power supply to an electromagnet 16.

A mechanical subassembly 14 acts on the contacts 12, to open and close them. This subassembly 14 is housed in the housing 1 and comprises a mechanism 141 on which the electromagnet 16 acts, and a mechanism 142 with which a manually controlled button 17 and a trip device 18 cooperate, and this trip device itself cooperates with the mechanism 141, and mechanisms 141 and 142 may have some common parts.

The mobile contacts of poles 11 may be controlled by the manual control button 17 placed on the front of the switch. It is used to open the poles manually and to reset the device after tripping.

The mechanism 142 entrains a mobile part 61, preferably consisting of a rod and intended to actuate the first auxiliary contacts. The rod 61 can be moved in translation to take up three positions; an On position, an Off position and a tripped position, depending on the state of the mechanism 14, to represent the On (ready) state of the device, or its Off state or its Tripped state. It has actuators such as 61A, and the position of the actuators represents the state (On-Off-Tripped) of the control mechanism 14.

The electromagnet 16 entrains a mobile part 62 preferably composed of a rod and intended to actuate the second auxiliary contacts. The rod 62 can be moved in translation from a working position to a rest position and vice versa in response to the electromagnet 16 being switched. It has actuators such as 62A used to control the contacts.

These rods 61 and 62 are guided in the housing 1 to slide along their length (parallel to the power lines as shown in FIG. 1).

The control part is associated with an electronic protection and control module 2 which, in a preferred embodiment, is removably connected to housing 1 containing the control part. This protection and control module 2 is located below the part housing the electromagnet, the trip device and the mechanical subassembly.

The protection and control module 2 is L-shaped, and one of the arms of the L houses the current sensors 21 and the other houses the electronics. It has connectors 26 on the side opposite the visible face that cooperate with the connectors 19 to make the electronic circuit 22 of the protection module communicate with the electromagnet 16 and the trip mechanism 18. The protection module 2 performs a protection function and outputs a fault signal to the trip device 18 when a fault (short circuit) current is detected by the said sensor, the trip device 18 then controlling opening of the contacts 12.

The protection and control module 2 houses the current sensors 21 that will detect a current passing in a pole. Each of the sensors 21 is connected through connectors 25 to power line segments 15B and 15C that are located on the output side of the pole 11, the power line being completed by a segment 15A on the input side of the pole. Each sensor 21 of the module 2 is connected through its outputs to an electronic protection circuit 22 that is connected to the electromagnet coil 16 by connectors 26B–19B and to the electromagnetic trip device through connectors 26A–19A.

The electronic protection circuit 22 also receives a power supply voltage from the power supply terminals A1 and A2 laid out visibly on the front of the housing near the bottom. These terminals are connected to conductors that are housed in the housing and are connected through connectors 24 to conductors in the protection module 2 leading to pins on the electronic circuit 22. This power supply voltage applied to terminals A1 and A2 is used to power the protection module, the trip device and the coil. The power supply connectors 24 are located close to the power connectors 25 connecting the current sensors 21 to the power conductors 15.

Below the protection module 2, the switch is provided with a space used to house a removable control or communication module 3 in the form of a cassette.

Some modules 3 are provided with mechanical or electronic contacts or switches 31*a* and 31*b* near the back, that are manoeuvred by actuators 61A and 62A.

On the side adjacent to module 3, the protection module 2 is fitted with a connector 23 which has several pins, the function of which will be described below, and that match a connector 33 of module 3 when module 3 is put into place below the protection module 2.

Connector 23-33 enables information exchanges between module 3 and the protection circuit 22 of the protection module 2. This connector 23-33 has 6 pins that are connected to pins Vc1, Vc2, Dsq, Rst, Set, Gnd of the electronic circuit 22.

The output pin Vc1 of the circuit 22 on which a capacitor is wired outputs a positive voltage to the coil of the control electromagnet 16.

The output pin Vc2 of circuit 22 on which a capacitor is wired outputs a positive voltage that activates the trip device 18.

Pin Dsq of circuit 22 outputs a voltage that is an instantaneous image of the ratio Im/Ir, where Im is the current circulating in the power conductors 15, Ir is the nominal device usage current that is displayed on the front of the protection module 2 and that the customer can adjust.

The output pin Rst of the circuit 22 outputs a "reset" order.

The output pin Set of the circuit 22 outputs several signals from the protection circuit 22 that represent faults, namely the prealarm, magnetic fault, temperature fault, internal fault, etc.

The Gnd pin in circuit 22 is the ground, which is the common reference point between the protection module 2 and the communication module 3.

Figure 5:
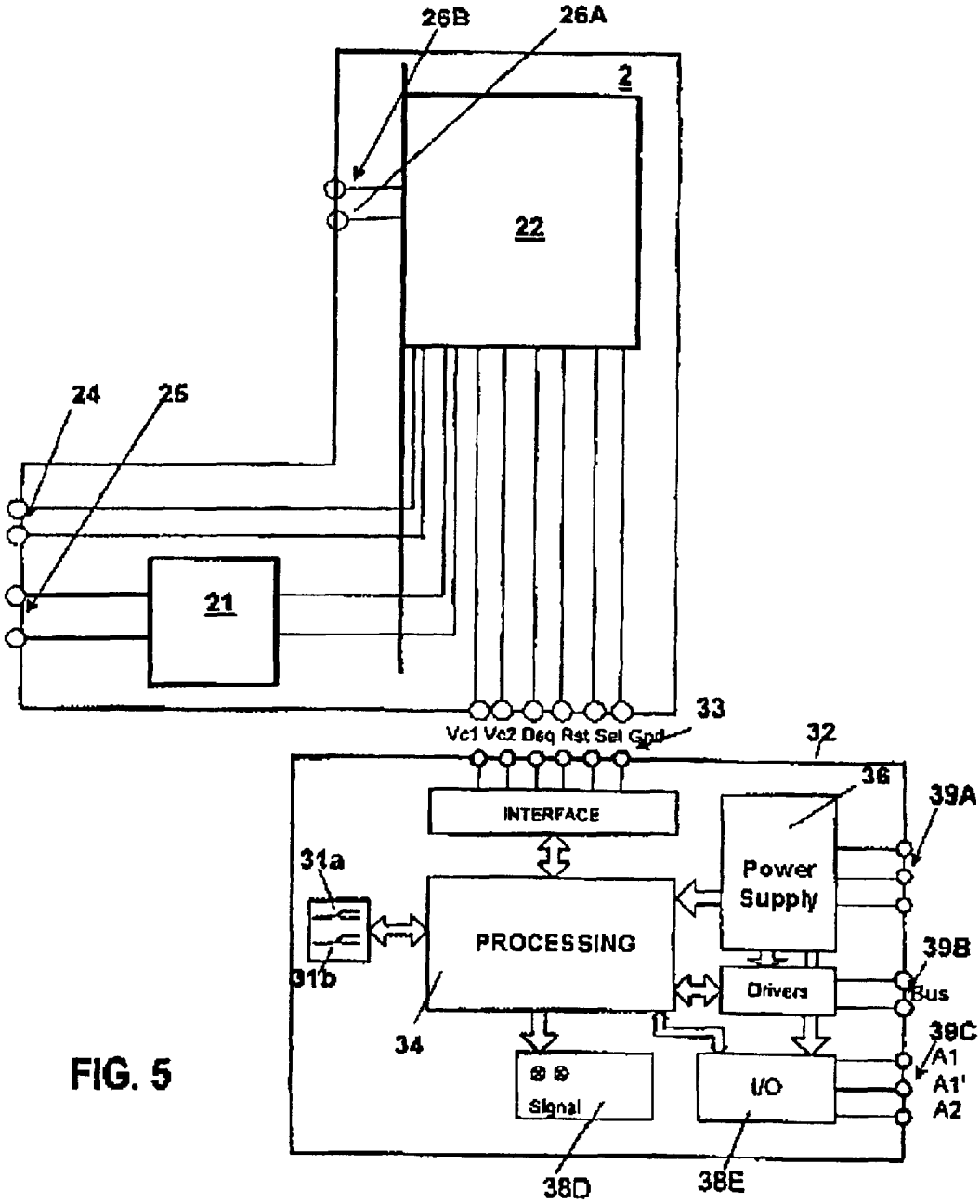
FIG. 5 is a functional diagram of a module performing a communication function and the associated protection module.

The communication module 3, for which the electronic diagram is illustrated in FIG. 5, is fitted with the protection module 2 and receives the various signals Vc1, Vc2, Dsq, Rst, Set, Gnd. These signals are sent through an interface to a processing circuit 34 that also receives state information about the contacts 31*a* and 31*b* and is powered from an external connector 39A. This processing circuit 34 exchanges information through the connector 39B for the communication bus (field bus) and controls terminals A1, A'1, A2 of a connector 39C, through an input-output circuit 38E. Terminals A1 and A2 are directly connected to terminals A1 and A2 of the basic product or an associated inverter module, through a pre-wiring subassembly.

Figure 6:
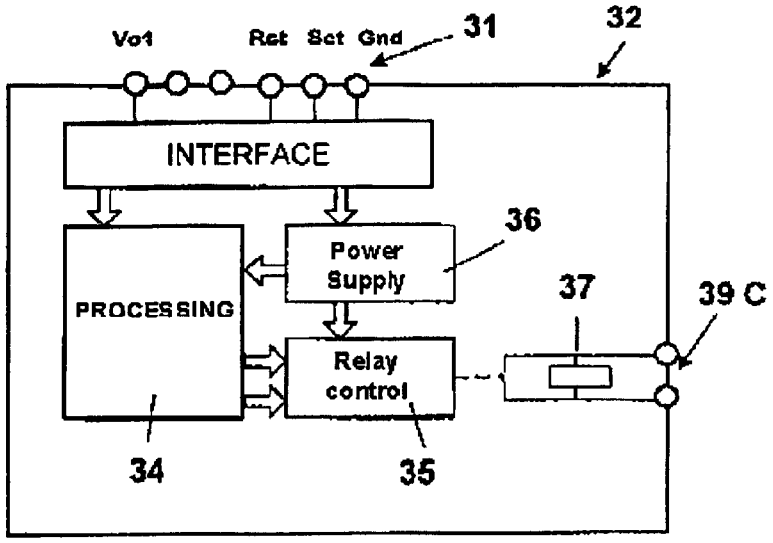
FIG. 6 is a functional diagram of a module performing a pre-alarm function or a fault management function.

Module 3, for which the electronic diagram is illustrated in FIG. 6, performs a prealarm or fault management function. It receives the Vc1 and Gnd signals that are sent through an interface to a processing circuit 34 powered by Vc1 and Gnd and a power supply circuit 36. This processing circuit 34 controls a relay output 39C on the front of the module, through a control circuit 35 and a relay 37. The relay output indicates that a given temperature state is exceeded or a fault (short circuit, temperature fault, etc.).

Figure 7:
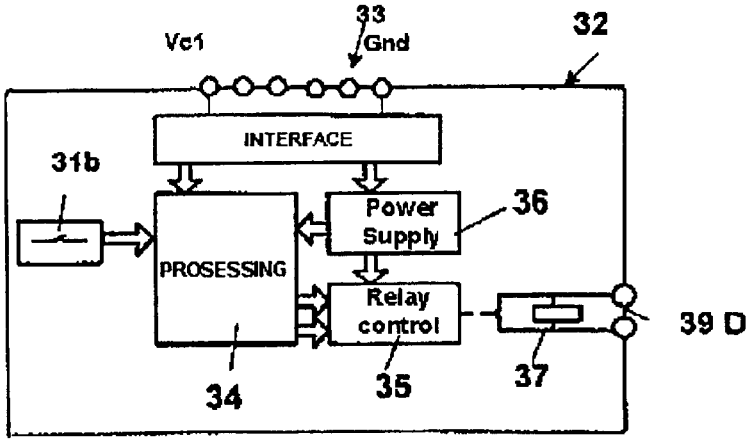
FIG. 7 is a functional diagram of a module performing a timed auxiliary contacts function.

Module 3 with timed signal auxiliary contacts, for which the electronic diagram is illustrated in FIG. 7, receives the Vc1 and Gnd signals that are sent through an interface to a processing circuit powered by Vc1 and Gnd and a power supply circuit 36. This processing circuit 34 also receives information about the state of the contact 31*b* activated by the actuator representing the state of the poles. This processing circuit 34 controls a relay output 39*d* through a control circuit 35 and a relay 37. The relay output 39D represents the open or closed state of the electromagnet and therefore poles with a time-out.

Figure 8:
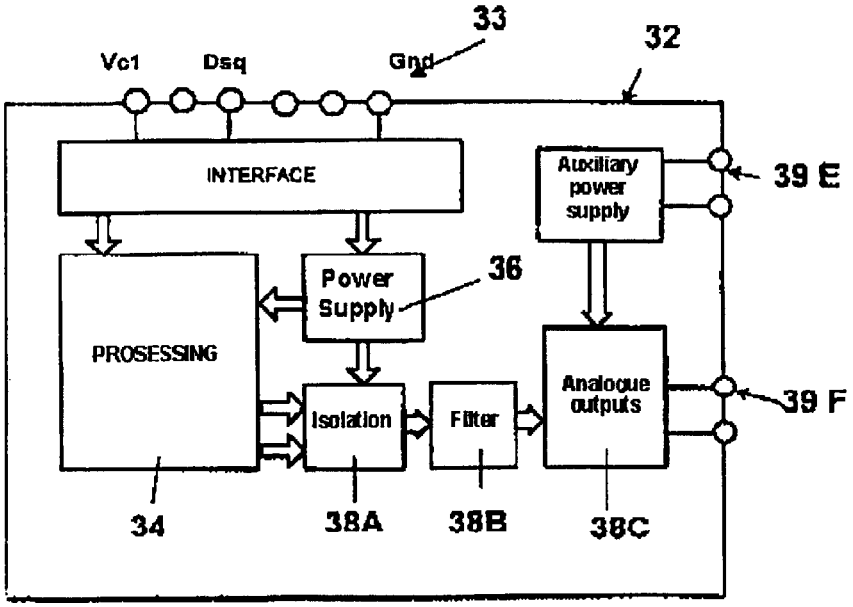
FIG. 8 is a functional diagram of a module performing a motor load display function.

Module 3 with display of the motor load for which the electronic diagram is shown in FIG. 8, receives the Vc1, Dsq and Gnd signals that are sent through an interface to a processing circuit 34 powered by Vc1 and Gnd and a power supply circuit 36. The processing circuit 34 outputs analogue information that can be used for example to control a display or to provide information about the motor load to a controller, through a circuit 38A, a filter 38B and a circuit with analogue outputs 38C, on an output 39F. A connector 39E can be provided for an auxiliary power supply.

A slot is provided below module 3 in which a module 4 can be placed, and a second slot is provided in which a module 5 can be fitted. The module 3 may be sufficiently high to cover the housing of the module dedicated to fault functions and located below it.

Obviously, it will be possible to imagine variants and improvements to detail and even to consider the use of equivalent meand, without departing from the scope of the invention.

What is claimed:

1. Multi-pole contactor-circuit breaker type switch comprising:

an electromagnet including a coil;

an electromagnetic trip device;

power current lines comprising breaking poles;

a housing containing the breaking poles, the electromagnet and the trip device;

a protection module comprising means for measuring currents of power lines and protection and control electronic means comprising a first connector connected to said means for measuring currents and connected to the electromagnet coil and to the electromagnetic trip device for controlling the electromagnet and the trip device and for outputting signals;

a control-communication module removably located on the housing and comprising at least one switch, a processing circuit and a second connector for communicating through the second connector with the first connector of the protection module and controlling at least one output;

a mechanical subassembly actuatable by the electromagnet and trip device, and for operating the breaking poles; and actuating means actuatable by at least one of the electromagnet and the trip device, and for actuating said at least one switch according to the state of at least one of the trip device and the electromagnet.

2. The multipole switch according to claim 1, wherein the control-communication module comprises state switches located at the back of the module, for mechanical activation by said activating means.

3. The multipole switch according to claim 1, wherein the protection module is L-shaped with two arms, has a visible face and a side opposite the visible face, wherein one of the arms houses the means for measuring currents of said breaking poles and the other arm houses said protection and control electronic means and further comprises connectors on the side opposite the visible face, that enable the means for controlling the electromagnet to communicate with the electromagnet and the trip mechanism.

4. The multipole switch according to claim 1, further comprising control supply terminals located in the housing and supply connectors located in the protection module, wherein said supply terminals are connected through the supply connectors to the protection and control electronic means of the protection module.

5. The multipole switch according to claim 4, further comprising power connectors connecting the means for measuring currents to the power conductors, wherein the supply connectors are located adjacent to the power connectors.

6. The multipole switch according to claim 1, further comprising at least one capacitor, wherein the control-communication module is for communicating with at least one output (Vc1, Vc2) from the protection and control electronic means of the protection module which is for outputting a positive voltage for the electromagnet or the trip mechanism.

7. The multipole switch according to claim 1, wherein the control-communication module is for communicating with at least one output (Dsq) from the protection and control electronic means, said output (Dsq) for outputting a voltage for an instantaneous image of a ratio (lm/lr) of current circulating in power conductors to a nominal usage current.

8. The multipole switch according to claim 1, wherein the control-communication module is for communicating with at least one output (Set) of the protection and control electronic means of the protection module, wherein said at least one output (Set) is for outputting several signals that represent faults.

9. The multipole switch according to claim 1, wherein the control-communication module is for communicating with at least one output (Rst) of the protection and control electronic means of the protection module, wherein said at least one output (Rst) is for outputting a "reset" order, and an output (Gnd) from the protection and control electronic means is for forming a ground.

10. The multipole switch according to claim 2, wherein the processing circuit is for receiving information originating from said state switches.

11. The multipole switch according to claim 1, further comprising a manually controlled button, a trip device and a mechanical sub-assembly for acting on contacts of the breaking poles, the sub-assembly comprising a first mechanism on which the electromagnet acts and a second mechanism with which said manually controlled button and said trip device cooperate.

12. The multipole switch according to claim 2, wherein said state switches are for mechanical activation by said pole control electromagnet and provide state information about the poles.

13. The multipole switch according to claim 1, wherein said outputs include signal means.

14. The multipole switch according to claim 1, wherein the protection module is removable and the control-communication module is located below the protection module.

15. Multi-pole contactor-circuit breaker type switch comprising:

an electromagnet including a coil;

an electromagnetic trip device;

power conductors comprising breaking poles;

a mechanical subassembly actuatable by the electromagnet and trip device, and for operating the breaking poles; and a housing containing the breaking poles, the electromagnet and the trip device, and a mechanical sub-assembly;

a protection module comprising means for measuring currents of power conductors;

protection and control electronic means connected to said means for measuring currents, said protection module for controlling the electromagnet and the trip device;

actuating means actuatable by at least one of the electromagnet and the trip device, and for actuating at least one switch according to the state of at least one of the trip device and the electromagnet, and a control-communication module removably located on the housing and comprising a back surface and said at least one state switch located on said back surface for mechanical activation by said activating means, said control-communication module further comprising a processing circuit for communicating with said at least one state switch and controlling at least one output.

* * * * *